US012593869B2

(12) United States Patent
Batista et al.

(10) Patent No.: US 12,593,869 B2
(45) Date of Patent: Apr. 7, 2026

(54) ADJUSTABLE RETAINING MEMBER FOR AN AEROSOL-GENERATING DEVICE

(71) Applicant: Philip Morris Products S.A., Neuchatel (CH)

(72) Inventors: Rui Nuno Batista, Neuchatel (CH); Ricardo Cali, Mannheim (DE); Andreas Lob, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 560 days.

(21) Appl. No.: 17/759,536

(22) PCT Filed: Jan. 28, 2021

(86) PCT No.: PCT/EP2021/052020
§ 371 (c)(1),
(2) Date: Jul. 27, 2022

(87) PCT Pub. No.: WO2021/152035
PCT Pub. Date: Aug. 5, 2021

(65) Prior Publication Data

US 2023/0088876 A1 Mar. 23, 2023

(30) Foreign Application Priority Data

Jan. 29, 2020 (EP) ..... 20154298

(51) Int. Cl.
*A24F 40/40* (2020.01)
*A24D 1/20* (2020.01)
*A24F 40/50* (2020.01)

(52) U.S. Cl.
CPC ..... *A24F 40/40* (2020.01); *A24F 40/50* (2020.01)

(58) Field of Classification Search
CPC ..... A24F 40/50; A24F 40/40
See application file for complete search history.

(56) References Cited

U.S. PATENT DOCUMENTS

2007/0235048 A1* 10/2007 Yasui ..... B41J 2/164 131/272
2015/0013696 A1 1/2015 Plojoux et al.
(Continued)

FOREIGN PATENT DOCUMENTS

CN 202664230 U 1/2013
CN 203607898 U 5/2014
(Continued)

OTHER PUBLICATIONS

Translation of CN106880086 (Year: 2017).*
(Continued)

*Primary Examiner* — Philip Y Louie
*Assistant Examiner* — Nicole A Szumigalski
(74) *Attorney, Agent, or Firm* — Oblon, McClelland, Maier & Neustadt, L.L.P.

(57) ABSTRACT

An aerosol-generating device is provided, including: a device housing defining a cavity; an adjustable retaining element positioned in or adjacent to the cavity and defining a passage; and an actuator configured to actuate the element between receiving and retaining positions, in which a cross-sectional dimension of the passage is greater when the element is in the receiving position than when in the retaining position, the element defining a passage entrance and a passage exit and includes a surface defined between the entrance and the exit, a longitudinal cross-section of the surface having a curved shape when the element is in the retaining position, a portion of the curved shape including a convex curve defining a constriction in the passage at a turning point of the curve, and the element being compressed in a longitudinal direction when the element is actuated from the receiving position to the retaining position.

14 Claims, 5 Drawing Sheets

(56) References Cited

U.S. PATENT DOCUMENTS

| | | | | |
|---|---|---|---|---|
| 2018/0000154 | A1* | 1/2018 | Morgan | A24F 1/08 |
| 2019/0166909 | A1 | 6/2019 | Reevell | |
| 2020/0268047 | A1 | 8/2020 | Doyle | |

FOREIGN PATENT DOCUMENTS

| | | | | |
|---|---|---|---|---|
| CN | 103997922 | A | 8/2014 | |
| CN | 106136330 | A | 11/2016 | |
| CN | 106880086 | A * | 6/2017 | A24F 47/008 |
| CN | 107568803 | A | 1/2018 | |
| CN | 108451028 | A | 8/2018 | |
| CN | 109770432 | A | 5/2019 | |
| CN | 208875404 | U | 5/2019 | |
| CN | 209073557 | U | 7/2019 | |
| EP | 2 782 463 | A2 | 10/2014 | |
| GB | 505021 | A | 5/1939 | |
| JP | 2014-533513 | A | 12/2014 | |
| JP | 2019-519201 | A | 7/2019 | |
| KR | 1020140093694 | A | 7/2014 | |
| KR | 1020180134914 | A | 12/2018 | |
| KR | 10-2019-0027650 | A | 3/2019 | |
| KR | 10-2019-0089276 | A | 7/2019 | |
| RU | 2 617 297 | C2 | 4/2017 | |
| RU | 2 643421 | C2 | 2/2018 | |
| WO | WO03/056948 | A1 | 7/2003 | |
| WO | WO2015/089712 | A1 | 6/2015 | |
| WO | WO2018/190606 | A1 | 10/2018 | |
| WO | WO2019/014992 | A1 | 1/2019 | |
| WO | WO 2019/081602 | A1 | 5/2019 | |
| WO | WO 2019/224120 | A1 | 11/2019 | |
| WO | WO 2021/037655 | A1 | 3/2021 | |
| WO | WO 2021/037822 | A1 | 3/2021 | |
| WO | WO 2021/037824 | A1 | 3/2021 | |

OTHER PUBLICATIONS

Combined Russian Notice of Allowance and Search Report issued May 20, 2024 in Russian Patent Application No. 2022122843/03 (with English Translation of Category of Cited Documents), 14 pages.

International Search Report & Written Opinion issued Apr. 26, 2021 in PCT/EP2021/052020, filed on Jan. 28, 2021, 11 pages.

Extended European Search Report issued Jul. 17, 2020, in corresponding European Patent Application No. 20154298.2, 22 pages.

International Preliminary Report on Patentability and Written Opinion issued Jul. 28, 2022, in PCT/EP2021/052020, 8 pages.

Japanese Notice of Allowance issued Dec. 2, 2024 in Japanese Patent Application No. 2022-545807, 2 pages.

Chinese Office Action and Search Report issued Mar. 22, 2025 in corresponding Chinese Patent Application No. 202180011450.9, with English Translation, 21 pages.

Chinese Notice of Allowance issued Sep. 1, 2025 in corresponding Chinese Patent Application No. 202180011450.9, 4 pages.

Notice of Allowance dated Dec. 4, 2025 issued in corresponding Korean Patent Application No. 10-2022-7029125.

* cited by examiner

ADJUSTABLE RETAINING MEMBER FOR AN AEROSOL-GENERATING DEVICE

The present disclosure relates to an aerosol-generating device.

It is known to provide an aerosol-generating device for generating an inhalable vapour. Such devices may heat an aerosol-forming substrate to a temperature at which one or more components of the aerosol-forming substrate are volatilised without burning the aerosol-forming substrate. An aerosol-forming substrate may be provided as part of an aerosol-generating article. The aerosol-generating article may have a rod shape for insertion of the aerosol-generating article into a cavity of the aerosol-generating device. Once received in the cavity, the aerosol-generating device may heat the aerosol-generating article.

In some arrangements, the aerosol-generating device comprises a heating element in the form of a blade located within the cavity of the aerosol-generating device. The heating element may penetrate the aerosol-forming substrate of an aerosol-generating article inserted into the cavity. Alternatively, a heating arrangement may be arranged around the cavity for heating the aerosol-forming substrate once the aerosol-generating article is received by the cavity of the aerosol-generating device.

In either case, it is advantageous for the aerosol-generating article to be retained in the aerosol-generating device in order to prevent the aerosol-generating article falling out of the cavity when the aerosol-generating device is in use and to provide efficient heating of the aerosol-forming substrate by the aerosol-generating device. A heating blade may retain the aerosol-generating article within the cavity prior to heating the aerosol-generating article. Alternatively or additionally, retention of aerosol-generating article in the cavity may be achieved by interference as a result of the diameter of the cavity corresponding to the diameter of the aerosol-generating article prior to heating the aerosol-generating article, particularly for heating arrangements arranged around the cavity.

However, during operation, the dimensions of the aerosol-generating article and the cavity may change as a result of the heating of the aerosol-generating article. For example, the heated aerosol-generating article, and particularly the diameter of the aerosol-forming substrate, may shrink. The diameter of the cavity may increase as a result of thermal expansion when the aerosol-generating device is in operation. Furthermore, the aerosol-forming substrate contained in the aerosol-generating article may be depleted over time. This may further influence the shape of the aerosol-generating article. Particularly, with progressing depletion, the aerosol-forming substrate may shrink. The change in dimensions of the aerosol-generating article and the cavity during heating may result in unwanted loosening of the aerosol-generating article received in the cavity.

An aerosol-generating device having a cavity with dimensions corresponding to a particular aerosol-generating article also has the disadvantage that it may be difficult for a user to insert the aerosol-generating article into the cavity. Furthermore, such an aerosol-generating device is only able to be used with aerosol-generating articles having a particular diameter.

It would be desirable to provide an aerosol-generating device in which insertion of an aerosol-generating article into a cavity of the aerosol-generating device is improved and such that aerosol-generating articles of various diameter can be inserted into the cavity. It would be desirable to provide an aerosol-generating device in which the retention of an aerosol-generating article received in the cavity is improved and such that aerosol-generating articles of various diameter can be retained in the cavity. It would also be desirable to provide an aerosol-generating device in which loosening of an aerosol-generating article received in a cavity is prevented, particularly after heating.

In this disclosure there is provided an aerosol-generating device. The aerosol-generating device may comprise a device housing. The device housing may define a cavity. The aerosol-generating device may also comprise an adjustable retaining element. The adjustable retaining element may be positioned in or adjacent to the cavity. The adjustable retaining element may define a passage. The aerosol-generating device may also comprise an actuation means. The actuation means may be configured to actuate the adjustable retaining element between a receiving position and a retaining position. A cross-sectional dimension of the passage may be greater when the adjustable retaining element is in the receiving position than when the adjustable retaining element is in the retaining position.

In one example, the aerosol-generating device comprises a device housing defining a cavity; an adjustable retaining element positioned in or adjacent to the cavity and defining a passage; and an actuation means configured to actuate the adjustable retaining element between a receiving position and a retaining position; wherein a cross-sectional dimension of the passage is greater when the adjustable retaining element is in the receiving position than when the adjustable retaining element is in the retaining position.

By providing an adjustable retaining element positioned in, or adjacent to, the cavity, any object received in, or removed from, the cavity must pass through the passage defined by the adjustable retaining element. An object received in the cavity may also be received in the passage.

Objects having a cross-sectional dimension smaller than the equivalent cross-sectional dimension of the passage when the adjustable retaining element is in the receiving position can advantageously pass freely through the passage. This ensures that the insertion or removal of such an object into the cavity is unhindered by the adjustable retaining element in the receiving position. If the equivalent cross-sectional dimension of such an object is also greater than or equal to the cross-sectional dimension of the passage when the adjustable retaining element is in retaining position, the object is prevented from passing through the passage. This is particularly advantageous when a distal end of the object is received in the cavity and the remaining portion of the object protrudes out of the cavity to be received in the passage. In such an arrangement, the adjustable retaining element advantageously contacts the object and retains the object in the passage. Where the cross-sectional dimension of the passage is less than the cross-sectional dimension of the object and the object is received in the passage, either the object or the adjustable retaining element may be slightly deformed when the adjustable retaining element is in the retaining position.

By providing an adjustable retaining element defining a passage having a cross-sectional dimension that changes when the adjustable retaining element is actuated between a receiving position and a retaining position, a range of sizes of object can advantageously be received and retained by the adjustable retaining element.

As used herein, the term "cross-sectional dimension" is used to refer generally to any dimension of a two-dimensional cross-section of the passage. The cross-section of the passage may be a transverse cross-section of the passage. As used herein, the term "transverse cross-section" refers to a cross-section defined through the width of the passage such that the cross-section is perpendicular to length of the passage. In particular, the transverse cross-section may be perpendicular to the direction of insertion of objects passing through the passage into the cavity. Cross-sectional dimensions include the width or the area of the cross-section of the passage. Different shaped cross-sections may have different cross-sectional dimensions. For example, if the passage has a circular cross-section then the diameter of cross-section is a cross-sectional dimension.

The adjustable retaining element may be deformed when the adjustable retaining element is actuated from the receiving position to the retaining position. The deformed adjustable retaining means may constrict the passage. The cross-sectional dimension may be related to the cross-section of a constriction in the passage.

The cross-sectional dimension of the passage may be the width of the passage. The width of the passage may be the width of a transverse cross-section of the passage. The width of the passage when the adjustable retaining element is in the receiving position may be between 5 millimeters and 13 millimeters. Preferably, the width of the passage when the adjustable retaining element is in the receiving position may be between 6 millimeters and 9 millimeters. The width of passage when the adjustable retaining element is in the receiving position may be larger than the width of an object to be received in or pass through the passage.

The width of the passage when the adjustable retaining element is in the retaining position may be between 3 millimeters and 8 millimeters. Preferably, the width of the passage when the adjustable retaining element is in the retaining position may be between 2.5 millimeters and 6.5 millimeters. The width of the passage when the adjustable retaining element is in the retaining position may be smaller than, or equal to, the width of an object to be received or pass through the passage.

The adjustable retaining element may circumferentially encircle the passage. The cross-sectional dimension of the passage may be the cross-sectional area of the passage. The cross-sectional dimension of the passage may be the cross-sectional area of transverse cross-section of the passage. The cross-sectional area of the passage when the adjustable retaining element is in the receiving position may be between 20 millimeters squared and 130 millimeters squared. For example, when the diameter of the passage when the adjustable retaining element is in the receiving position is 5 millimeters, the cross-sectional area of the passage is 19.6 millimeters squared. Preferably, the cross-sectional area of the passage when adjustable retaining element is in the receiving position may be between 30 millimeters squared and 60 millimeters squared. The cross-sectional area of the passage when the adjustable retaining element is in the receiving position may be larger than the cross-sectional area of an object to be received in or pass through the passage.

The cross-sectional area of the passage when the adjustable retaining element is in the retaining position is between 7 millimetres squared and 50 millimetres squared. For example, when the diameter of the passage when the adjustable retaining element is in the retaining position is 3 millimeters, the cross-sectional area of the passage is 7.1 millimeters squared. Preferably, the cross-sectional area of the passage when the adjustable retaining element is in the retaining passage may be between 5 millimeters squared and 30 millimeters squared. The cross-sectional area of the passage when the adjustable retaining element is in the retaining position may be smaller than, or equal to, the cross-sectional area of an object to be received in or pass through the passage.

The adjustable retaining element may define a passage entrance and a passage exit. The cross-sectional dimension of the passage may be variable between the passage entrance and the passage exit when the adjustable retaining element is in the retaining position. The cross-sectional dimension of the passage may be constant between the passage entrance and passage exit when the adjustable retaining element is in the receiving position. Alternatively, the cross-sectional dimension of the passage may vary to a lesser extent than when the adjustable retaining element is in the retaining position. In other words, the profile of the passage between the passage entrance and the passage exit may be different when the adjustable retaining element is in the receiving position compared to when the adjustable retaining element is in the retaining position. This may be a result of the adjustable retaining element being deformed when the adjustable retaining element is actuated from the retaining position to the receiving position.

The cross-sectional dimension may be a minimum cross-sectional area of the passage. The cross-sectional dimension may be a minimum cross-sectional area of the passage when the adjustable retaining element is in the retaining position.

In the retaining position, the adjustable retaining element may comprise a surface defined between the passage entrance and the passage exit, a longitudinal cross-section of the surface having curved shape. In other words, in the retaining position, the transverse cross-sectional dimension of the passage may be variable between the passage entrance and the passage exit. A portion of the curved shape may comprise a convex curve that defines a constriction in the passage at a turning point of the convex curve. The constriction may form a point of contact between the adjustable retaining element and an object received in the passage of the adjustable retaining element. The constriction may retain the object within the passage of the adjustable retaining element. The cross-sectional dimension may be a cross-sectional dimension of the constriction.

As used herein, the term "longitudinal cross-section" is used to refer to a cross-section defined through the adjustable retaining element parallel to the length of the passage. A longitudinal cross-section may be defined in a direction perpendicular to the transverse cross-section, as described above. As such, the longitudinal cross-section may be defined in a direction parallel to the direction of insertion of objects passing through the passage into the cavity.

The curved shape may comprise a second convex curve that defines a second constriction in the passage at a turning point of the second convex curve. The second constriction may form a second point of contact between the adjustable retaining element and an object received in the passage of the adjustable retaining element. The cross-sectional dimension of the second constriction may be the same as the cross-sectional dimension of first constriction.

The surface may extend around a portion of the passage to form a toroid, a partial toroid or a truncated toroid.

The distance between the passage entrance and the passage exit may be reduced by between 2.5 millimeters and 5 millimeters when the adjustable retaining element is actuated from the receiving position to the retaining position. By reducing the distance between the passage entrance and the passage exit, the adjustable retaining element may be deformed. The deformation may reduce the cross-sectional dimension. A reduction of between 2.5 millimeters and 5 millimeters may deform the adjustable retaining element such that the cross-sectional dimension is reduced to be less than or equal to the cross-sectional dimension of an object to be inserted in the cavity.

The adjustable retaining element may be annular. The adjustable retaining element may be configured to radially contract when the adjustable retaining element is actuated from the receiving position to the retaining position. The adjustable retaining element may contract equally around the radius of the passage.

The cavity may be a cavity for receiving an aerosol-generating article. The cavity may be a cavity for receiving at least a distal portion of the aerosol-generating article. A portion of an aerosol-generating article received in the cavity may be located within the passage.

The aerosol-generating article may be in the shape of a rod. In other words, the aerosol-generating article may have a circular cross-section. In such cases, it is preferable that the adjustable retaining element is annular. The adjustable retaining element in the retaining position may contact the aerosol-generating article received in the cavity around the entire circumference of the aerosol-generating article.

An annular adjustable retaining element may radially contract. An annular adjustable retaining element may advantageously contract equally around the radius of the passage. An annular adjustable retaining element may advantageously radially contract to contact the aerosol-generating article around its full circumference when the annular adjustable retaining element is in the retaining position. An annular adjustable retaining element may advantageously apply an equal pressure around the circumference of the aerosol-generating article.

The aerosol-generating article may have a diameter of between 3 millimeters and 8 millimeters. Preferably, the aerosol-generating article may have a diameter of between 4 millimeters and 7 millimeters. Preferably, the diameter of the passage when the adjustable retaining element is in the receiving position is greater than the diameter of the aerosol-generating article.

The diameter of the aerosol-generating article may be between 0.5 millimeters and 3.5 millimeters less than the width of the passage when the adjustable retaining element is in the receiving position. This advantageously ensures that the aerosol-generating article is unhindered by the adjustable retaining element. The aerosol-generating article may be unhindered by the adjustable retaining element when the aerosol-generating article is inserted or removed from the cavity, through the passage.

Preferably, the diameter of the passage when the adjustable retaining element is in the retaining position is less than or equal to the diameter of the aerosol-generating article. This may advantageously ensure that contact remains between the adjustable retaining element and the aerosol-generating article despite variability of the diameter aerosol-generating article, for example, during heating of the aerosol-generating article.

The aerosol-generating article may have a cross-sectional area of between 5 millimeters squared and 50 millimeters squared. For example, if the cross-sectional diameter of the aerosol-generating article is 3 millimeters the cross-sectional area of the aerosol-generating article may be 7.1 millimeters squared. Preferably, the aerosol-generating article may have a cross-sectional area of between 10 millimeters squared and 40 millimeters squared. Preferably, the cross-sectional area of the passage when the adjustable retaining element is in the receiving position is greater than the diameter of the aerosol-generating article.

Preferably, the cross-sectional area of the passage when the adjustable retaining element is in the retaining position is less than or equal to the diameter of the aerosol-generating article. The cross-sectional area of the aerosol-generating article may be between 3 millimetres squared and 60 millimetres squared less than the cross-sectional area of the passage when the adjustable retaining element is in the receiving position.

The aerosol-generating article may be freely receivable or removable from the cavity when the adjustable retaining element is in the receiving position. As such, inserting and removing the aerosol-generating article from the cavity may advantageously be simple.

The adjustable retaining element may be configured to contact the aerosol-generating article received in the cavity when the adjustable retaining element is in the retaining position. The adjustable retaining element may be configured to grip the aerosol-generating article received in the cavity when the adjustable retaining element is in the retaining position. An interference relationship between the aerosol-generating article and the adjustable retaining element may advantageously retain the aerosol-generating article within the cavity.

The adjustable retaining element may contact two separate portions of the aerosol-generating article. The two separate portions may be spaced apart along the length of the aerosol-generating article. By providing two points of contact between the aerosol-generating article and the adjustable retaining element is increased.

In the retaining position, the adjustable retaining element is configured to seal, for example, hermetically seal the cavity when the aerosol-generating article is received in the cavity while allowing airflow through the aerosol-generating article. An outer circumference of the resilient sealing element may be engaged to a housing of the aerosol-generating device. The attachment between the housing of the aerosol-generating device and the resilient sealing element may be a hermetically sealing attachment. The adjustable retaining element may allow airflow through passage defined by adjustable retaining element. However, after the insertion of an aerosol-generating article into the cavity, the passage may be filled by the aerosol-generating article so that air may only exit the cavity through the aerosol-generating article. Providing an adjustable retaining element configured to contact two portions of the aerosol-generating article when the adjustable retaining element is in the retaining position may result in an increased or more secure sealing effect.

The aerosol-generating article may be received by the cavity along a longitudinal direction. The adjustable retaining element may be compressed in the longitudinal direction when the adjustable retaining element is actuated from the receiving position to the retaining position. The adjustable retaining element may comprise a contact portion configured to move in a direction perpendicular to the longitudinal direction when the adjustable receiving element is actuated from the receiving position to the retaining position.

The contact portion of the adjustable retaining element may move towards the aerosol-generating article received in the cavity.

The contact portion of the adjustable retaining element may move a distance of between 1 millimetres and 4 millimetres. The contact portion of the adjustable retaining element may constrict the passage when the adjustable retaining element is in the retaining position.

The adjustable retaining element may be a resilient element. Such a resilient element may be actuatable between a receiving position and a retaining position having an adjustable cross-sectional dimension without the need for complicated mechanical fittings. For example, the resilient element can be deformed when actuated from the receiving position to the retaining position. The deformation may change the relevant cross-sectional dimension. Preferably, the resilient element may be deformed in a longitudinal direction resulting in a constriction of the passage defined by the resilient element.

Furthermore, a resilient element may apply a pressure to an aerosol-generating article in the passage and when the adjustable resilient element is in the retaining position. The resilient element may apply a pressure on the aerosol-generating article in the passage when the cross-sectional dimension of the passage is less than the cross-sectional dimension of the aerosol-generating article. This pressure retains the aerosol-generating article in place within the passage. The pressure may be applied in a direction perpendicular to the longitudinal direction.

The adjustable retaining element may be flexible. The adjustable retaining element may be elastic. The adjustable retaining element may have a central aperture through which the passage is defined. The adjustable retaining element may be made of a material having suitable elastic properties resulting in the adjustable retaining element being deformable between the receiving position and the retaining position. The adjustable retaining element may be made of an elastic, heat-resistant polymer or compound material such as graphene, silicone, plastics or other suitable materials or compounds of those. For example, it may be advantageous that at least a deformable portion of the adjustable retaining element is made from an elastomeric polymer, for example a butyl rubber such as polyisobutylene, a polysiloxane such as silicone, a polyurethane or another elastomer.

The actuation means may be moveable relative to the device housing. The actuation means may be moveable between a first position relative to the device housing in which the adjustable retaining element is in the receiving position and a second position relative to the device housing in which the adjustable retaining element is in the retaining position.

A first side of the adjustable retaining element may be engaged to the actuation means. The first side of the adjustable retaining element may define the passage entrance. A second side of the adjustable retaining element is engaged to the device housing. The second side of the adjustable retaining element may define the passage exit.

The actuation means may be engaged to the device housing by a thread and screw connection. The actuation means may be moveable with respect to the device housing via the thread and screw connection.

Alternatively, the actuation means may be engaged to the device housing via an engagement member. The engagement member may consist of one or more pins or runners formed in a housing of the actuation means. The pins or runners of the engagement member may engage a slot or groove formed in the device housing. The actuation means, being moveable with respect to the device housing, may be guided by the pins or runners of the engagement member moving in the slot or groove. The slot or groove may be configured such that the actuation means is moveable from a first position in which the adjustable retaining means is in the receiving position and a second position in which the adjustable retaining means in the retaining position. The slot or groove may be configured such that a user pushing on the actuation means in the longitudinal direction moves the actuation means from the first position to the second position.

The actuation means may comprise a spring. The spring may be in contact with the device housing. Moving the actuation means from the first position to the second position may deform the spring. The deformed spring may urge the actuation means to return to the first position.

The slot or groove may comprise a locking portion. The engagement member may be urged into the locking portion when the actuation means is in the second position. A user pushing on the actuation means in the longitudinal direction may urge the engagement member back out of the locking portion of the slot or groove. The user may push on the actuation means in the same direction both to move the actuation means from the first position to the second position and to move the engagement member out of locking portion of the slot or groove. The actuation member may then be urged into the first position by the spring. This arrangement is advantageously simple for a user to operate. The user need only push down on the actuation means to move it from the first position to second positon and return it back to the first position.

The actuation means may be rotatable between the first position and the second position. The first position and second position may be separated by between 90 degrees and 270 degrees. For example, the first position and second position may be separated by 180 degrees.

The actuation means may comprise a housing. The adjustable retaining element may be engaged to the housing of the actuation means. A portion of the cavity may be defined by the actuation means. A portion of the cavity may be defined by the housing of the actuation means.

As used herein, the term 'aerosol-generating device' is used to describe a device that interacts with an aerosol-generating substrate of an aerosol-generating article to generate an aerosol. Preferably, the aerosol-generating device is a device that interacts with the aerosol-generating substrate of an aerosol-generating article to generate an aerosol that is directly inhalable into a user's lungs thorough the user's mouth. The device may be configured to heat the aerosol-forming substrate. The device may comprise a heating arrangement. The heating arrangement may comprise a heater blade located in the cavity and configured to penetrate the aerosol-forming substrate of the aerosol-generating article. Alternatively, the heating arrangement may be arranged around the cavity.

The heating arrangement may be a resistive heating arrangement.

Alternatively, the heating arrangement may be an induction heating arrangement. The induction heating arrangement may be configured to generate heat by means of induction. The induction heating arrangement may comprise an induction coil and a susceptor arrangement. A single induction coil may be provided. A single susceptor arrangement may be provided. Preferably, more than a single induction coil is provided. A first induction coil and a second induction coil may be provided. Preferably, more than a single susceptor arrangement is provided. Preferably, a first susceptor arrangement and a second susceptor arrangement are provided. The induction coil may surround the susceptor arrangement. The first induction coil may surround the first susceptor arrangement. The second induction coil may surround the second susceptor arrangement. Alternatively, at least two induction coils may be provided surrounding a single susceptor arrangement. If more than one susceptor arrangements are provided, preferably electrically insulating elements are provided between the susceptor arrangements.

The induction coil may be arranged in a coil compartment. The coil compartment may be hermetically sealed from the cavity by a thermally insulating element at the downstream end of the cavity. The coil compartment may be arranged to surround the cavity. The coil compartment may partly or fully surround the cavity. The coil compartment may extend along the full length of the cavity. The coil compartment may house the induction coil or multiple induction coils.

The aerosol-generating device may comprise a downstream air inlet connected with the coil compartment. Alternatively, the aerosol-generating device may comprise an air inlet adjacent an upstream end of the cavity. The air inlet may be fluidly connected with the air aperture in the base of the cavity.

The aerosol-generating device may comprise a power supply. The power supply may be a direct current (DC) power supply. The power supply may be electrically connected to the first induction coil. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts). The aerosol-generating device may advantageously comprise a direct current to alternating current (DC/AC) inverter for converting a DC current supplied by the DC power supply to an alternating current. The DC/AC converter may comprise a Class-D or Class-E power amplifier. The power supply may be configured to provide the alternating current.

The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the aerosol-generating device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be configured to operate at high frequency. As used herein, the term "high frequency oscillating current" means an oscillating current having a frequency of between 500 kilohertz and 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The susceptor arrangement may comprise a susceptor. the susceptor arrangement may comprise multiple susceptors. The susceptor arrangement may comprise blade shaped susceptors. The blade shaped susceptors may be arranged surrounding the cavity. The blade shaped susceptors may be arranged inside of the cavity. The blade shaped susceptors may be arranged for holding the aerosol-generating article, when the aerosol-generating article is inserted into the cavity. The blade shaped susceptors may have flared downstream ends to facilitate insertion of the aerosol-generating article into the blade shaped susceptors. Air may flow into the cavity through the air aperture in the base of the cavity. The air may subsequently enter into the aerosol-generating article at the upstream end face of the aerosol-generating article. Alternatively or additionally, air may flow between the sidewall of the cavity and the blade shaped susceptors. The air may then enter into the aerosol-generating article through gaps between the blade shaped susceptors. A uniform penetration of the aerosol-generating article with air may be achieved in this way, thereby optimizing aerosol generation.

The aerosol-generating device may comprise a flux concentrator. The flux concentrator may be made from a material having a high magnetic permeability. The flux concentrator may be arranged surrounding the induction heating arrangement. The flux concentrator may concentrate the magnetic field lines to the interior of the flux concentrator thereby increasing the heating effect of the susceptor arrangement by means of the induction coil.

The aerosol-generating device may comprise a controller. The controller may be electrically connected to the induction coil. The controller may be electrically connected to the first induction coil and to the second induction coil. The controller may be configured to control the electrical current supplied to the induction coils, and thus the magnetic field strength generated by the induction coils.

The power supply and the controller may be connected to the induction coil, preferably the first and second induction coils, and configured to provide the alternating electric current to each of the induction coils independently of each other such that, in use, the induction coils each generate the alternating magnetic field. This means that the power supply and the controller may be able to provide the alternating electric current to the first induction coil on its own, to the second induction coil on its own, or to both induction coils simultaneously. Different heating profiles may be achieved in that way. The heating profile may refer to the temperature of the respective induction coil. To heat to a high temperature, alternating electric current may be supplied to both induction coils at the same time. To heat to a lower temperature or to heat only a portion of the aerosol-forming substrate of the aerosol-generating article, alternating electric current may be supplied to the first induction coil only. Subsequently, alternating electric current may be supplied to the second induction coil only.

The controller may be connected to the induction coils and the power supply. The controller may be configured to control the supply of power to the induction coils from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the induction coils. Current may be supplied to one or both of the induction coils continuously following activation of the aerosol-generating device or may be supplied intermittently, such as on a puff by puff basis.

The power supply and the controller may be configured to vary independently the amplitude of the alternating electric current supplied to each of the first induction coil and the second induction coil. With this arrangement, the strength of the magnetic fields generated by the first and second induction coils may be varied independently by varying the amplitude of the current supplied to each coil. This may facilitate a conveniently variable heating effect. For example, the amplitude of the current provided to one or both of the coils may be increased during start-up to reduce the initiation time of the aerosol-generating device.

The first induction coil of the aerosol-generating device may form part of a first circuit. The first circuit may be a resonant circuit. The first circuit may have a first resonant frequency. The first circuit may comprise a first capacitor. The second induction coil may form part of a second circuit.

The second circuit may be a resonant circuit. The second circuit may have a second resonant frequency. The first resonance frequency may be different from the second resonance frequency. The first resonance frequency may be identical to the second resonance frequency. The second circuit may comprise a second capacitor. The resonant frequency of the resonant circuit depends on the inductance of the respective induction coil and the capacitance of the respective capacitor.

The cavity of the aerosol-generating device may have an open end into which an aerosol-generating article is inserted. The cavity may have a closed end opposite the open end. The closed end may be the base of the cavity. The closed end may be closed except for the provision of the air apertures arranged in the base. The base of the cavity may be flat. The base of the cavity may be circular. The base of the cavity may be arranged upstream of the cavity. The open end may be arranged downstream of the cavity.

The cavity may be configured as a heating chamber. The cavity may have a cylindrical shape. The cavity may have a hollow cylindrical shape. The cavity may have a circular cross-section. The cavity may have an elliptical or rectangular cross-section. The cavity may have a diameter corresponding to the diameter of the aerosol-generating article.

As used herein, the term "proximal" refers to a user end, or mouth end of the aerosol-generating device, and the term "distal" refers to the end opposite to the proximal end. When referring to the cavity, the term "proximal" refers to the region closest to the open end of the cavity and the term "distal" refers to the region closest to the closed end.

As used herein, the term "length" refers to the major dimension in a longitudinal direction of the aerosol-generating device, of an aerosol-generating article, or of a component of the aerosol-generating device or an aerosol-generating article.

As used herein, the term "width" refers to the major dimension in a transverse direction of the aerosol-generating device, of an aerosol-generating article, or of a component of the aerosol-generating device or an aerosol-generating article, at a particular location along its length. The term "thickness" refers to the dimension in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick. The aerosol-generating article may be insertable into the cavity of the aerosol-generating device.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In the system, the aerosol-generating article and the aerosol-generating device cooperate to generate a respirable aerosol. The invention may also relate to an aerosol-generating system.

As used herein, a "susceptor arrangement" means a conductive element that heats up when subjected to a changing magnetic field. This may be the result of eddy currents induced in the susceptor arrangement, hysteresis losses, or both eddy currents and hysteresis losses. During use, the susceptor arrangement is located in thermal contact or close thermal proximity with the aerosol-forming substrate of an aerosol-generating article received in the cavity of the aerosol-generating device. In this manner, the aerosol-forming substrate is heated by the susceptor arrangement such that an aerosol is formed.

The susceptor arrangement may have a cylindrical shape, preferably constituted by individual blade shaped susceptors. The susceptor arrangement may have a shape corresponding to the shape of the corresponding induction coil. The susceptor arrangement may have a diameter smaller than the diameter of the corresponding induction coil such that the susceptor arrangement can be arranged inside of the induction coil.

The term "heating zone" refers to a portion of the length of the cavity which is at least partially surrounded by the induction coils so that the susceptor arrangement placed in or around the heating zone is inductively heatable by the induction coils. The heating zone may comprise a first heating zone and a second heating zone. The heating zone may be split into the first heating zone and the second heating zone. The first heating zone may be surrounded by the first induction coil. The second heating zone may be surrounded by the second induction coil. More than two heating zones may be provided. Multiple heating zones may be provided. An induction coil may be provided for each heating zone. One or more induction coils may be arranged moveable to surround the heating zones and configured for segmented heating of the heating zones.

The term "coil" as used herein is interchangeable with the terms "inductive coil" or "induction coil" or "inductor" or "inductor coil" throughout. A coil may be a driven (primary) coil connected to the power supply.

Preferably, the aerosol-generating device is portable. The aerosol-generating device may have a size comparable to a conventional cigar or cigarette. The system may be an electrically operated smoking system. The system may be a handheld aerosol-generating system. The aerosol-generating device may have a total length between approximately 10 millimetres and approximately 150 millimetres. The aerosol-generating device may have an external diameter between approximately 5 millimetres and approximately 30 millimetres.

The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and nonbrittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user. Preferably, the mouthpiece may be provided as part of an aerosol-generating article.

As used herein, the term "mouthpiece" refers to a portion of an aerosol-generating device or an aerosol-generating article that is placed into a user's mouth in order to directly inhale an aerosol generated by the aerosol-generating device from an aerosol-generating article received in the cavity of the housing.

Operation of the heating arrangement may be triggered by a puff detection system. Alternatively, the heating arrangement may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the mouthpiece of the device, the cavity such as the heating chamber or any other passage or chamber within the aerosol-generating device, through which the air flows. When the user draws on the aerosol-generating device, a negative pressure or vacuum is generated inside the device, wherein the negative pressure may be detected by the pressure sensor.

The term "negative pressure" is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

The aerosol-generating device may include a user interface to activate the aerosol-generating device, for example a button to initiate heating of the aerosol-generating device or display to indicate a state of the aerosol-generating device or of the aerosol-forming substrate.

The aerosol-generating system is a combination of an aerosol-generating device and one or more aerosol-generating articles for use with the aerosol-generating device. However, the aerosol-generating system may include additional components, such as, for example a charging unit for recharging an on-board electric power supply in an electrically operated or electric aerosol-generating device.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate may comprise a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1, 3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the cavity of the aerosol-generating device may be arranged such that the aerosol-generating article is partially received within the cavity of the aerosol-generating device. The cavity of the aerosol-generating device and the aerosol-generating article may be arranged such that the aerosol-generating article is entirely received within the cavity of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article.

The aerosol-generating article may comprise a filter plug. The filter plug may be located at a downstream end of the aerosol-generating article. The filter plug may be a cellulose acetate filter plug. The filter plug may be a hollow cellulose acetate filter plug. The filter plug is approximately 7 millimetres in length in one embodiment, but may have a length of between approximately 5 millimetres to approximately 10 millimetres.

As used herein, the terms 'upstream' and 'downstream' are used to describe the relative positions of components, or portions of components, of the aerosol-generating device in relation to the direction in which a user draws on the aerosol-generating device during use thereof.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

In this disclosure there is also provided an aerosol-generating system. The aerosol-generating system may comprise an aerosol-generating device and an aerosol-generating article. The aerosol-generating device may comprise a device housing. The device housing may define a cavity. The aerosol-generating device may also comprise an adjustable retaining element. The adjustable retaining element may be positioned in or adjacent to the cavity. The adjustable retaining element may define a passage. The aerosol-generating device may also comprise an actuation means. The actuation means may be configured to actuate the adjustable retaining element between a receiving position and a retaining position. A cross-sectional dimension of the passage may be greater when the adjustable retaining element is in the receiving position than when the adjustable retaining element is in the retaining position. The aerosol-generating article may be received in the cavity.

In one example, the aerosol-generating system comprises an aerosol-generating device and an aerosol-generating article; the aerosol-generating device comprising: a device housing defining a cavity; an adjustable retaining element positioned in or adjacent to the cavity and defining a passage; and an actuation means configured to actuate the adjustable retaining element between a receiving position and a retaining position; wherein a cross-sectional dimension of the passage is greater when the adjustable retaining element is in the receiving position than when the adjustable retaining element is in the retaining position; and wherein the aerosol-generating article is received in the cavity.

In this disclosure there is also provided a method of retaining an aerosol-generating article in an aerosol-generating device. The aerosol-generating device may comprise a device housing defining a cavity. The aerosol-generating device may also comprise an actuation means. The aerosol-generating device may also comprise an adjustable retaining element. The adjustable retaining element may be positioned in or adjacent to the cavity. The adjustable retaining element may define a passage. The method may comprise the step of inserting the aerosol-generating article into the cavity. The method may also comprise the step of actuating the adjustable retaining element from a receiving position to a retaining position. A cross-sectional dimension of the passage may be greater when the adjustable retaining element is in the receiving position than when the adjustable retaining element is in the retaining position.

In one example of the method of retaining an aerosol-generating article in an aerosol-generating device; the aerosol-generating device comprising a device housing defining a cavity, an actuation means and an adjustable retaining element positioned in or adjacent to the cavity, the adjustable retaining element defining a passage, the method comprising the step of:

inserting the aerosol-generating article into the cavity; and actuating the adjustable retaining element from a receiving position to a retaining position;

wherein a cross-sectional dimension of the passage is greater when the adjustable retaining element is in the receiving position than when the adjustable retaining element is in the retaining position.

The step of actuating the adjustable retaining element may comprise moving the actuation means relative to the device housing. The step of actuating the adjustable retaining element may comprise rotating the actuation means relative to the device housing. The actuation means may be rotated by at least 90 degrees. The actuation means may be rotated by at least 180 degrees.

The step of inserting an aerosol-generating article into the cavity may be performed when the adjustable element is in the receiving position.

The aerosol-generating article inserted in the cavity may be contacted by the adjustable retaining element when the adjustable retaining element is in the retaining position.

The aerosol-generating article may be freely receivable or removable from the cavity when the adjustable retaining element is in the receiving position.

The aerosol-generating article may be inserted in the cavity in a longitudinal direction. Actuating the adjustable retaining element from the receiving position to the retaining position may cause a portion of the adjustable retaining element to be urged to extend in a direction perpendicularly to the longitudinal direction.

The method may further comprise the step of actuating the adjustable retaining element from the retaining position to the receiving position. The step of actuating the adjustable retaining element from the retaining position to the receiving position may be performed after a user has consumed the aerosol-generating article.

The method may further comprise the step of removing the aerosol-generating article. Removing the aerosol-generating article after the adjustable retaining element has been actuated to the receiving position advantageously allows the aerosol-generating article to be unhindered by the adjustable retaining element when removed.

Features described in relation to one example or embodiment may also be applicable to other examples and embodiments. In particular, features of the actuation means and adjustable retaining element filter and the interaction of these features with an aerosol-generating article, as described in relation to the aerosol-generating device may also be applicable to other examples and embodiments.

Below, there is provided a non-exhaustive list of non-limiting examples. Any one or more of the features of these examples may be combined with any one or more features of another example, embodiment, or aspect described herein.

EX1. An aerosol-generating device comprising:

a device housing defining a cavity;

an adjustable retaining element positioned in or adjacent to the cavity and defining a passage; and an actuation means configured to actuate the adjustable retaining element between a receiving position and a retaining position;

wherein a cross-sectional dimension of the passage is greater when the adjustable retaining element is in the receiving position than when the adjustable retaining element is in the retaining position.

EX2. An aerosol-generating device according to example EX1, wherein the adjustable retaining element is deformed when the adjustable retaining element is actuated from the receiving position to the receiving position.

EX3. An aerosol-generating device according to example EX2, wherein the deformed adjustable retaining means constricts the passage.

EX4. An aerosol-generating device according to any one of examples EX1 to EX3, wherein the cross-sectional dimension of the passage is the width of the passage.

EX5. An aerosol-generating device according to example EX4, wherein the width of the passage when the adjustable retaining element is in the receiving position is between 5 millimeters and 13 millimeters.

EX6. An aerosol-generating device according to example EX4 or EX5, wherein the width of the passage when the adjustable retaining element is in the retaining position is between 3 millimeters and 8 millimeters.

EX7. An aerosol-generating device according to any one of the preceding examples, wherein the adjustable retaining element circumferentially encircles the passage.

EX8. An aerosol-generating device according to any one of the preceding examples, wherein the cross-sectional dimension of the passage is the cross-sectional area of the passage.

EX9. An aerosol-generating device according to example EX8, wherein the cross-sectional area of the passage when the adjustable retaining element is in the receiving position is between 20 millimeters squared and 130 millimeters squared.

EX10. An aerosol-generating device according to example EX8 or EX9, wherein the cross-sectional area of the passage when the adjustable retaining element is in the retaining position is between 7 millimetres squared and 60 millimetres squared.

EX11. An aerosol-generating device according to any one of the preceding examples, wherein the adjustable retaining element defines a passage entrance and a passage exit.

EX12. An aerosol-generating device according example EX11, wherein the cross-sectional area of the passage is constant between the passage entrance and passage exit when the adjustable retaining element is in the retaining position.

EX13. An aerosol-generating device according to example EX11 or EX12, wherein the cross-sectional area of the passage is variable between the passage entrance and the passage exit when the adjustable retaining element is in the receiving position.

EX14. An aerosol-generating device according to example EX13, wherein the cross-sectional dimension is a minimum cross-sectional area of the passage.

EX15. An aerosol-generating device according to any one of examples EX11 to EX14, wherein, in the retaining position, the adjustable retaining element comprises a surface defined between the passage entrance and the passage exit, a cross-section of the surface having a curved shape.

EX16. An aerosol-generating device according to example EX15, wherein a portion of the curved shape comprises convex curve that defines a constriction in the passage at a turning point of the convex curve.

EX17. An aerosol-generating device according to any example EX16, wherein the curved shape comprises a second convex curve that defines a second constriction in the passage at a turning point of the second convex curve.

EX18. An aerosol-generating device according to any one of examples EX15 to EX17, wherein the surface extends around a portion of the passage to form a toroid.

EX19. An aerosol-generating device according to any one of examples EX15 to EX18, wherein the surface extends around a portion of the passage to form a partial toroid.

EX20. An aerosol-generating device according to any one of examples EX15 to EX19, wherein the surface extends around a portion of the passage to form a truncated toroid.

EX21. An aerosol-generating device according to any one examples EX15 to EX20, wherein the distance between the passage entrance and the passage exit is reduced by between 2.5 millimeters and 5 millimeters when the adjustable retaining element is actuated from the receiving position to the retaining position.

EX22. An aerosol-generating device according to any one of the preceding examples, wherein the adjustable retaining element is annular.

EX23. An aerosol-generating device according to example EX22, wherein the adjustable retaining element is configured to radially contract when the adjustable retaining element is actuated from the receiving position to the retaining position.

EX24. An aerosol-generating device according to any one of the preceding examples, wherein the cavity is a cavity for receiving an aerosol-generating article.

EX25. An aerosol-generating device according to example EX24, wherein the cavity is for receiving at least a distal portion of the aerosol-generating article.

EX26. An aerosol-generating device according to examples EX24 or EX25, wherein a portion of an aerosol-generating article received in the cavity is located within the passage.

EX27. An aerosol-generating device according to any one of examples EX24 to EX26, wherein the aerosol-generating article is in the shape of a rod.

EX28. An aerosol-generating device according to example EX27, wherein the aerosol-generating article has a diameter of between 3 millimeters and 8 millimeters.

EX29. An aerosol-generating device according to example EX27 or EX28, wherein the diameter of the aerosol-generating article is between 0.5 millimeters and 3.5 millimeters less than the width of the passage when the adjustable retaining element is in the receiving position.

EX30. An aerosol-generating device according to any one of examples EX27 to EX29, wherein the aerosol-generating article has a cross-sectional area of between 5 millimeters squared and 50 millimeters squared.

EX31. An aerosol-generating device according to any one of examples EX27 to EX30, wherein the cross-sectional area of the aerosol-generating article is between 3 millimetres squared and 60 millimetres squared less than the cross-sectional area of the passage when the adjustable retaining element is in the receiving position.

EX32. An aerosol-generating device according to any one of examples EX24 to EX31, wherein the aerosol-generating article is freely receivable or removable from the cavity when the adjustable retaining element is in the receiving position.

EX33. An aerosol-generating device according to any one of examples EX24 to EX32, wherein the adjustable retaining element is configured to contact the aerosol-generating article received in the cavity when the adjustable retaining element is in the retaining position.

EX34. An aerosol-generating device according to any one of examples EX24 to EX33, wherein the adjustable retaining element contacts two separate portions of the aerosol-generating article, the portions being spaced apart along the length of the aerosol-generating article.

EX35. An aerosol-generating device according to examples EX33 or EX34, wherein an interference relationship between the aerosol-generating article and the adjustable retaining element retains the aerosol-generating article in the cavity when the adjustable retaining element is in the retaining position.

EX36. An aerosol-generating device according to any one of examples EX33 to EX35, wherein, in the retaining position, the adjustable retaining element is configured to seal the cavity when the aerosol-generating article is received in the cavity while allowing airflow through the aerosol-generating article.

EX37. An aerosol-generating device according to any one of examples EX33 to EX36, wherein, in the retaining position, the adjustable retaining element is configured to hermetically seal the cavity when the aerosol-generating article is received in the cavity while allowing airflow through the aerosol-generating article.

EX38. An aerosol-generating device according to any one of examples EX24 to EX37, wherein the aerosol-generating article is received by the cavity along a longitudinal direction.

EX39. An aerosol-generating device according to example EX38, wherein the adjustable retaining element is compressed in the longitudinal direction when the adjustable retaining element is actuated from the receiving position to the retaining position.

EX40. An aerosol-generating device according to examples EX 38 or EX39, wherein the adjustable retaining element comprises a contact portion configured to move in a direction perpendicular to the longitudinal direction when the adjustable receiving element is actuated from the receiving position to the retaining position.

EX41. An aerosol-generating device according to example EX40, wherein the contact portion of the adjustable retaining element moves towards the aerosol-generating article received in the cavity.

EX42. An aerosol-generating article according to examples EX40 or EX41, wherein the contact portion of the adjustable retaining element moves a distance of between 1 millimetres and 4 millimetres.

EX43. An aerosol-generating device according to any one of examples EX40 to EX42, wherein the contact portion of the adjustable retaining element constricts the passage when the adjustable retaining element is in the retaining position.

EX44. An aerosol-generating device according to any one of the preceding examples, wherein the adjustable retaining element is a resilient element.

EX45. An aerosol-generating device according to any one of the preceding examples, wherein the adjustable retaining element is made of an elastic, heat-resistant polymer or compound material such as graphene, silicone, plastics or other suitable materials or compounds of those.

EX46. An aerosol-generating device according to any one of the preceding examples, wherein the actuation means is moveable relative to the device housing.

EX47. An aerosol-generating device according to example EX46, wherein the actuation means is moveable between a first position relative to the device housing in which the adjustable retaining element is in the receiving position and a second position relative to the device housing in which the adjustable retaining element is in the retaining position.

EX48. An aerosol-generating device according to example EX46 or EX47, wherein the actuation means has a second position relative to the device housing in which the adjustable retaining element is in the retaining position.

EX49. An aerosol-generating device according to any one of examples EX46 to EX48, wherein a first side of the adjustable retaining element is engaged to the actuation means.

EX50. An aerosol-generating device according to example EX49, wherein a second side of the adjustable retaining element is engaged to the device housing.

EX51. An aerosol-generating device according to any one of examples EX46 to EX50, wherein the actuation means is rotatable between the first position and the second position.

EX52. An aerosol-generating device according to example EX51, wherein the first position and second position are separated by between 90 degrees and 270 degrees.

EX53. An aerosol-generating device according to any one of the preceding examples, wherein the actuation means is engaged to the device housing by a thread and screw connection.

EX54. An aerosol-generating device according to any one of the preceding examples, wherein the actuation means is engaged to the device housing by an engagement member.

EX55. An aerosol-generating device according to example EX54, wherein the engagement member consists of one or more pins or runners formed in a housing of the actuation means.

EX56. An aerosol-generating device according to example EX55, wherein the one or more pins and runners engage one or more slots or grooves formed in the device housing.

EX57. An aerosol-generating device according to example EX56, wherein the slot or groove comprises a locking portion.

EX58. An aerosol-generating device according to any one of the preceding examples, wherein the actuation means comprises a spring.

EX59. An aerosol-generating device according to example EX58, wherein the spring is in contact with the device housing.

EX60. An aerosol-generating device according to any one of the preceding examples, wherein a portion of the cavity is defined by the actuation means.

EX61. An aerosol-generating system comprising an aerosol-generating device and an aerosol-generating article;

the aerosol-generating device comprising:

a device housing defining a cavity;

an adjustable retaining element positioned in or adjacent to the cavity and defining a passage; and an actuation means configured to actuate the adjustable retaining element between a receiving position and a retaining position;

wherein a cross-sectional dimension of the passage is greater when the adjustable retaining element is in the receiving position than when the adjustable retaining element is in the retaining position; and wherein the aerosol-generating article is received in the cavity.

EX62. A method of retaining an aerosol-generating article in an aerosol-generating device; the aerosol-generating device comprising a device housing defining a cavity, an actuation means and an adjustable retaining element positioned in or adjacent to the cavity, the adjustable retaining element defining a passage, the method comprising the step of:

inserting the aerosol-generating article into the cavity; and actuating the adjustable retaining element from a receiving position to a retaining position;

wherein a cross-sectional dimension of the passage is greater when the adjustable retaining element is in the receiving position than when the adjustable retaining element is in the retaining position.

EX63. A method of retaining an aerosol-generating article in an aerosol-generating device according to example EX62, further comprising the step of inserting an aerosol-generating article into the cavity may be performed when the adjustable element is in the receiving position.

EX64. A method of retaining an aerosol-generating article in an aerosol-generating device according to example EX63, wherein the aerosol-generating article inserted in the cavity is contacted by the adjustable retaining element when the adjustable retaining element is in the retaining position.

EX65. A method of retaining an aerosol-generating article in an aerosol-generating device according to example EX63 or EX64, wherein the aerosol-generating article is freely receivable or removable from the cavity when the adjustable retaining element is in the receiving position.

EX66. A method of retaining an aerosol-generating article in an aerosol-generating device according to any one of examples EX63 to EX65, wherein the aerosol-generating article is be inserted in the cavity in a longitudinal direction.

EX67. A method of retaining an aerosol-generating article in an aerosol-generating device according to any one of examples EX63 to EX66, further comprising the step of actuating the adjustable retaining element from the retaining position to the receiving position.

EX68. A method of retaining an aerosol-generating article in an aerosol-generating device according to example EX67, wherein the method further comprises the step of removing the aerosol-generating article.

Examples will now be further described with reference to the figures in which.

Figure 1:
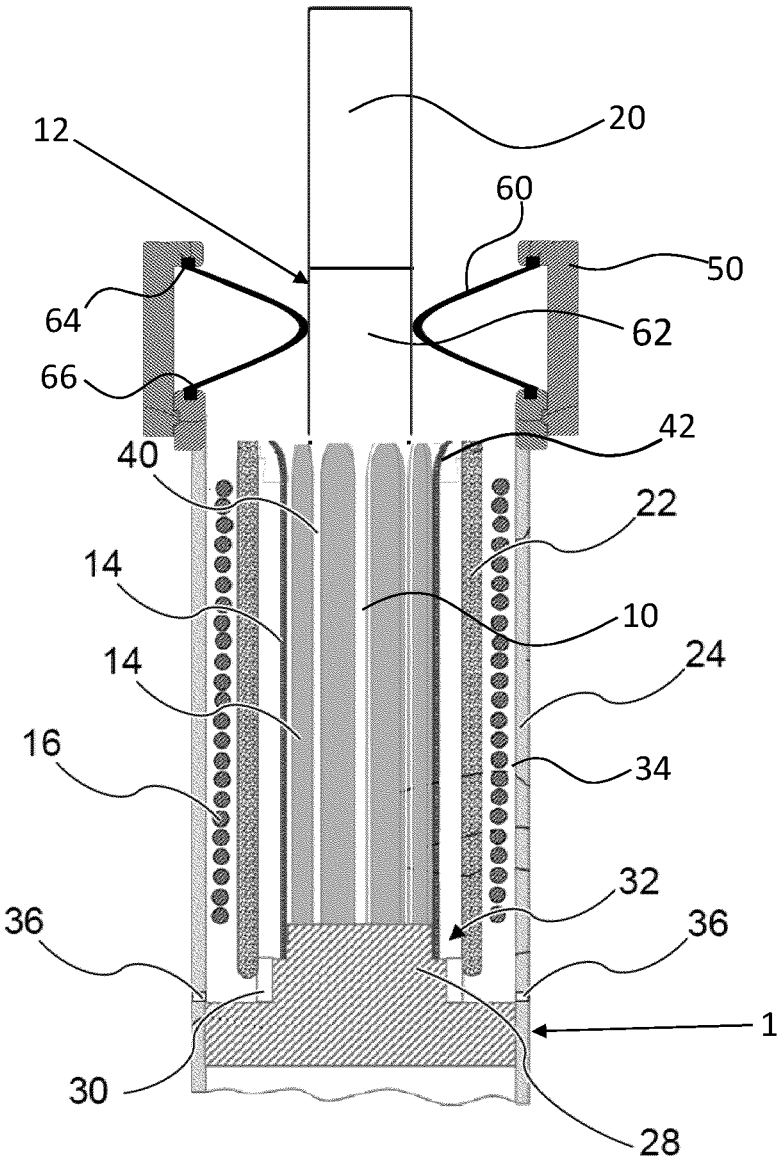
FIG. 1 shows a cross-sectional view of an aerosol-generating device in accordance with the invention comprising an aerosol-generating article received in a cavity of the aerosol-generating device.

FIG. 1 shows a proximal or downstream portion of an aerosol-generating device 1. The aerosol-generating device 1 comprises a cavity 10 for insertion of an aerosol-generating article. The cavity 10 is configured as a heating chamber. The cavity 10 is cylindrical.

Inside of the cavity 10, a susceptor arrangement 14 is arranged. The susceptor arrangement 14 comprises multiple susceptor blades. The individual susceptor blades are flared at respective downstream ends 42 to ease insertion of the aerosol-generating article 12 into the cavity 10. The inner diameter of the susceptor arrangement 14 corresponds or may be slightly smaller than the outer diameter of the aerosol-generating article 12.

The susceptor arrangement 14 is part of an induction heating arrangement. The induction heating arrangement comprises an induction coil 16. The induction coil 16 is arranged at least partly surrounding the cavity 10. The induction coil 16 surrounds the full circumference of the cavity 10. The induction coil 16 is arranged surrounding the susceptor arrangement 14. The induction coil 16 surrounds the part of the cavity 10, in which a substrate portion of the aerosol-generating article 12 is received. A filter portion 20 of the aerosol-generating article 12 sticks out of the cavity 10 after insertion of the aerosol-generating article 12 into the cavity 10. A user draws on the filter portion 20.

Between the individual susceptors of the susceptor arrangement 14, gaps 40 are provided. The gaps 40 enable airflow into the aerosol-generating article 12 after insertion of the aerosol-generating article 12 into the cavity 10. The gaps 40 preferably enable a radial airflow from the space of the cavity 10 between a thermally insulating element 22 and the susceptor arrangement 14 into the aerosol-generating article 12. Consequently, the gaps 40 enable an inward radial airflow. The gaps 40 have an elongate shape. The gaps 40 may extend along essentially the length of the substrate portion 18 of the aerosol-generating article 12.

The aerosol-generating device 1 may comprise further elements not shown in the figures such as a controller for controlling the induction heating arrangement. The controller may be configured to separately control individual coils, if the induction heating arrangement comprises more than one induction coil 16. The aerosol-generating device 1 may comprise a power supply such as a battery. The controller may be configured to control the supply of electrical energy from the power supply to the induction coil 16 or to the individual induction coils 16.

Between the susceptor arrangement 14 and the induction coil 16, a thermally insulating element 22 is arranged. The thermally insulating element 22 forms the sidewall of the cavity 10. The thermally insulating element 22 has an elongate extension. The thermally insulating element 22 has a hollow cylindrical shape. The thermally insulating element 22 is attached to a housing 24 of the aerosol-generating device 1. Preferably, the thermally insulating element 22 is attached to a downstream end of the housing 24 as depicted in FIG. 1. Additionally, the thermally insulating element 22 is attached to a base 28 of the cavity 10 at a downstream end of the cavity 10. In the base 28 of the cavity 10, one or more air apertures 30 are arranged.

The air aperture 30 has an elongate extension parallel to the longitudinal axis of the aerosol-generating device 1. The air aperture 30 allows air to enter into the cavity 10 at an upstream end 32 of the cavity 10. The thermally insulating element 22 prevents air from 25 entering into the cavity 10 in a lateral direction.

The induction coil 16 is arranged in a coil compartment 34. The coil compartment 34 is arranged surrounding the thermally insulating element 22. A layered structure is provided with the cavity 10 centrally in the middle. Surrounding the cavity 10, the thermally insulating element 22 is provided. Surrounding the thermally insulating element 22, the coil compartment 34 is arranged. Surrounding the coil compartment 34, the housing 24 of the aerosol-generating device 1 is provided.

An air inlet 36 is provided to enable ambient air to enter the coil compartment 34. The air inlet 36 is arranged at the downstream end of the housing 24. The air inlet 36 is arranged adjacent the coil compartment 34. The air inlet 36 is provided between the outer circumference of the housing 24 and the part of the downstream end of the housing 24 connected to the thermally insulating element 22. Alternatively, as shown in FIG. 1, the air inlet 36 is placed in the sidewall of the housing 24 of the aerosol-generating device 1. In other words, the air inlet 36 is placed in the outer circumference of the housing 24 of the aerosol-generating device 1. The air inlet 36 is arranged adjacent the upstream end of the cavity 10.

Although the aerosol-generating device 1 has been described as comprising an inductive heating system having a susceptor arrangement, this susceptor arrangement could be replaced with a resistive heating system. For example, the resistive heating system could comprise resistive heater blades instead of susceptor blades. The controller may be configured to control a supply of electrical energy from the power supply to the resistive heater blades.

Although the aerosol-generating device 1 has been described as comprising a susceptor arrangement configured to externally heat an aerosol-generating article, this susceptor arrangement could be replaced with a heating element that penetrates an aerosol-generating article received in the cavity. The heating element may be configured to penetrate the aerosol-forming substrate of the aerosol-generating article received in the cavity. The heating element may be a susceptor element operating similarly to the susceptor arrangement described above or may be a resistively heated heating element.

Although the aerosol-generating device 1 has been described as comprising the susceptor element, the susceptor element may instead be part of the aerosol-generating article.

The aerosol-generating device 1 also comprises an actuation means 50 and an adjustable retaining element 60. The adjustable retaining element 60 defines a passage 62. A first side of the adjustable retaining element 60 is engaged to the actuation means 50 and defines a passage entrance 64. A second side of the adjustable retaining element is engaged to the housing of the device 24 and defines a passage exit 66.

FIG. 1 shows the aerosol-generating article 12 inserted into the cavity 10 such that the distal end of the aerosol-generating article is received in the cavity. This distal end comprises an aerosol-forming substrate portion of the aerosol-generating article (not visible in the figures). A filter portion 20 of the aerosol-generating article protrudes out of the cavity for a user to draw on the aerosol-generating article 12. The protruding filter portion 20 of the aerosol-generating article is received in the passage 62. Therefore, while the cavity is defined within the device housing, the actuation means 50 and the passage defined by the adjustable retaining element effectively extend the cavity beyond the device housing 24.

The adjustable retaining element 60 can be actuated between a receiving position and a retaining position. The adjustable retaining element 60 of FIG. 1 is shown in a retaining position. The receiving position and retaining position of the adjustable retaining element 60 are shown more clearly in FIGS. 2 and 3 respectively.

Figure 2:
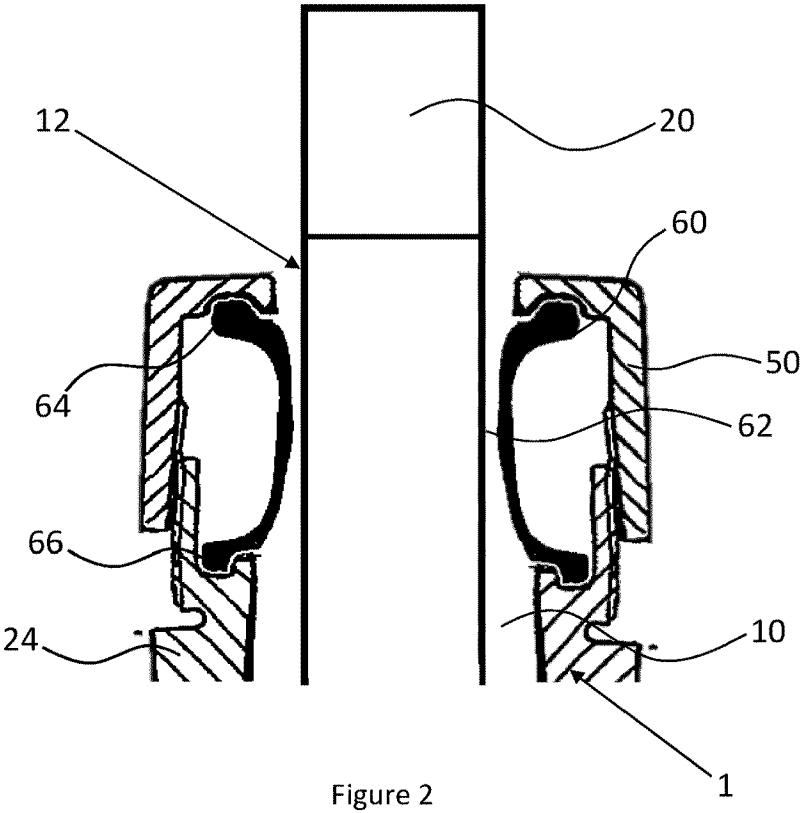
FIG. 2 shows a more detailed view of the adjustable retaining element of the aerosol-generating device of FIG. 1, the adjustable retaining element being in a receiving position.

In FIG. 2, the adjustable retaining element 60 is shown in a receiving position such that the adjustable retaining element 60 is not in contact with the aerosol-generating article 12. The width of the passage 62 defined by the adjustable retaining element 60 in the receiving position is greater than the than the diameter of aerosol-generating article 12. The cross-sectional area of the passage 62 defined by the passage is larger than the cross-sectional area of the aerosol-generating article. This configuration allows for the easy insertion of the aerosol-generating article 12 into the cavity.

Figure 3:
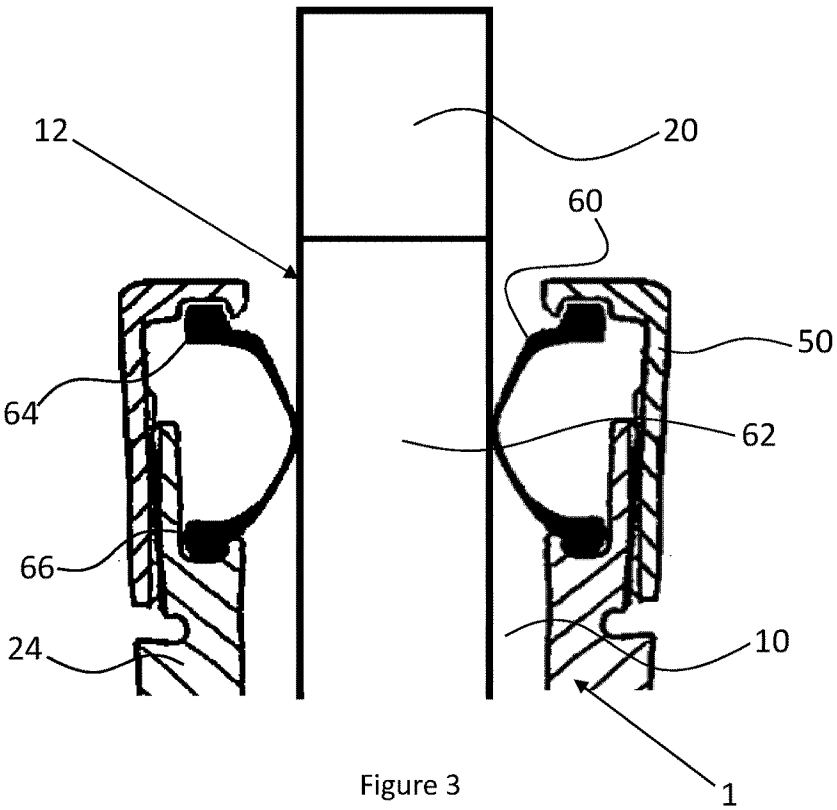
FIG. 3 shows a more detailed view of the adjustable retaining element of the aerosol-generating device of FIG. 1, the adjustable retaining element being in a retaining position.

In FIG. 3, the adjustable retaining element 60 is shown in a retaining position such that the adjustable retaining element is in contact with the aerosol-generating article 12. Without the aerosol-generating article 12 in the passage 62, the width of passage defined by the adjustable retaining element 60 in the retaining position is less than the than the diameter of aerosol-generating article 12. Similarly, the cross-sectional area of the passage 62 is smaller than the cross-sectional area of the aerosol-generating article 12. This means that when adjustable retaining element 60 is received in the passage, and the adjustable retaining element 60 is actuated to the retaining position, the adjustable retaining element 60 engages with and is deformed by an outer surface of the aerosol-generating article 12. The adjustable retaining element 60 is made from a resilient and elastic material. Therefore, the deformation of the adjustable retaining element 60 results in the adjustable retaining element 60 applying pressure on the aerosol-generating article 12. This pressure retains the aerosol-generating article 12 within the passage and so within the cavity.

The width of the passage when the adjustable retaining element is in the receiving position is 9 millimeters. The width of the passage when the adjustable retaining element is in the retaining position is 5 millimeters. Therefore, aerosol-generating articles 12 having a diameters of between 5 millimeters and 9 millimeters can be received and retained by the adjustable retaining element 60.

When an aerosol-generating article received in the cavity is heated, the aerosol-generating article may shrink. This may be a result of heating the aerosol-generating article when the aerosol-generating device is in operation and as a result of depletion of aerosol-forming substrate. This shrinkage may result in radial contraction of the aerosol-generating article. Therefore, the aerosol-generating articles 12 received in the passage preferably have a diameter of at least 5.5 millimeters. In other words, the aerosol-generating article 12 preferably has a diameter slightly greater than the width of the passage 62 when the adjustable retaining element 60 is in the retaining position. This ensures that contact is maintained between the adjustable retaining element 60 and the aerosol-generating article 12 even when there is variability of the diameter of the aerosol-generating article 12, for example, as a result of heating the aerosol-generating article 12.

The adjustable retaining element 60 is actuated between the receiving position and the retaining position by the actuation means 50. The actuation means 50 is moveable relative to the device housing 24. As shown in FIGS. 2 and 3, the actuation means 50 is configured to move up and down along the longitudinal direction with respect to the device housing 24. Because the adjustable retaining element 60 is engaged to the actuation means 50 at a first side of the adjustable retaining element and engaged to the housing 24 at a second side of the adjustable retaining element, moving the actuation means with respect the device housing 24 results in compression and deformation of the adjustable retaining element 60. In particular, the position of the actuation means 50 shown in FIG. 3 results in the first side and second side of the adjustable retaining element being brought closer compared to the position of the actuation means 50 as shown in FIG. 2. The distance between the first side and the second side is reduced 2.5 millimeters when adjustable retaining element is in the retaining position. This deforms the adjustable retaining element in the longitudinal direction.

The surface of the adjustable retaining element 60 defined between the passage entrance 62 and the passage exit 64 has a convex curve shape. The curvature of this convex curve shape is greater when the adjustable retaining element is in the retaining position. The turning point of the convex curve shape defines a constriction of the passage. It is at this constriction of the adjustable retaining element 60 that contacts the aerosol-generating article 12 received in the passage.

In the retaining position, the adjustable retaining element 60 directly abuts the outer circumference of the aerosol-generating article 12 so that air can only exit the cavity 10 through the aerosol-generating article 12. Air flows into the aerosol-generating device 1 through the air inlet 36. More than one air inlet 36 may be provided. The air flows through the coil compartment 34. After exiting the coil compartment 34, the air flows into the cavity 10 through the air aperture 30 arranged at the base 28 of the cavity 10. The air subsequently flows into the aerosol-generating article 12 through gaps provided between the individual susceptor blades. The adjustable retaining element 60 is air impenetrable to prevent air from escaping the cavity 10 except for escaping through the aerosol-generating article 12. The adjustable retaining element 60 completely surrounds the downstream end of the cavity 10.

Figure 4:
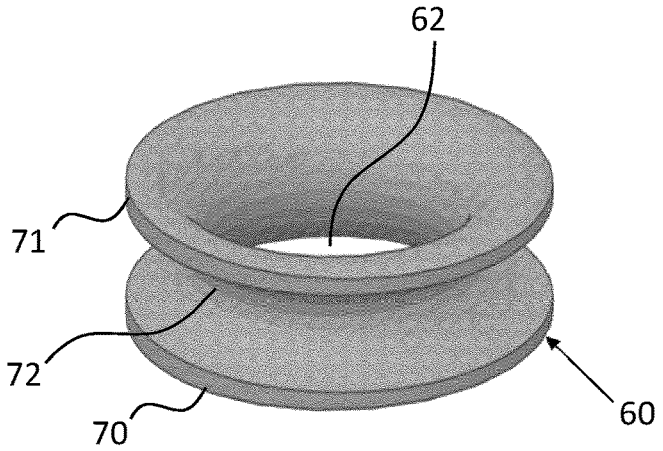
FIG. 4 shows a perspective view of the adjustable retaining element separately to the rest of the aerosol-generating device shown in FIG. 1.

FIG. 4 shows a perspective view of the adjustable retaining element separately from the rest of the aerosol-generating device 1. The adjustable retaining element 60 is annular and has a toroidal shape. More specifically, the adjustable retaining element 60 comprises two coaxially disposed rings 70,71 joined by an annular, inwardly curved, sheet of resilient material 72. The coaxially disposed rings 70,71 are integrally formed with the sheet of resilient material 72. One of the coaxially disposed rings 70 is configured to engage the device housing 24. The other of the coaxially disposed rings 71 is configured to engage the actuation means 50. The separation between the two coaxially disposed rings 70,71 is greater when the adjustable retaining element is in the receiving position than when the adjustable retaining element is in the retaining position. The actuation means 50 actuates the adjustable retaining element 60 by bring one of coaxially disposed rings closer to the other coaxially disposed ring. deformation of the adjustable retaining element in the longitudinal direction and radial contraction of sheet of resilient material 72 such that the passage 62 defined by the adjustable retaining element 60 is constricted. The dimensions of width and cross-sectional area of the passage referred to above are measured at this constriction.

Figure 5:
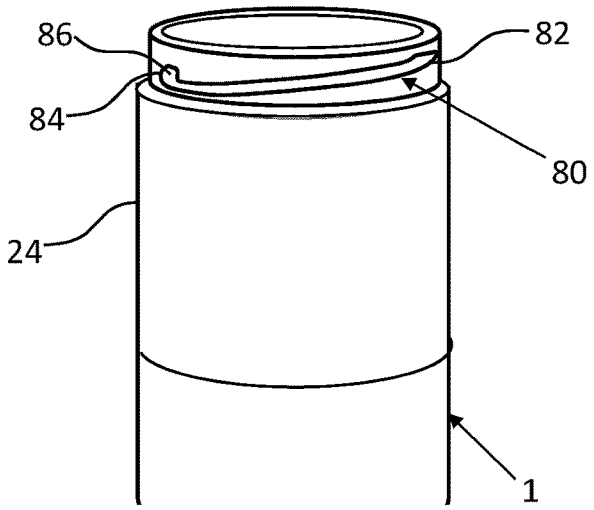
FIG. 5 shows a perspective view of the distal end of the aerosol-generating device of FIG. 1 but without the actuation means.
Figure 6:
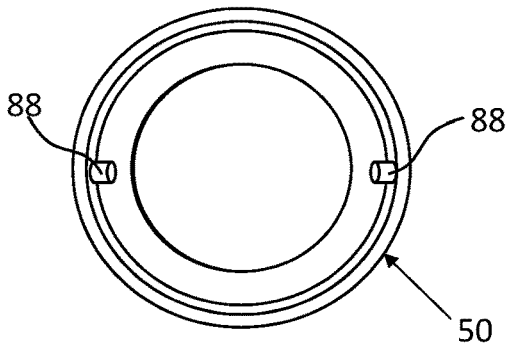
FIG. 6 shows a bottom view of the actuation means of FIG. 1 shown separately to the aerosol-generating device.
Figure 7:
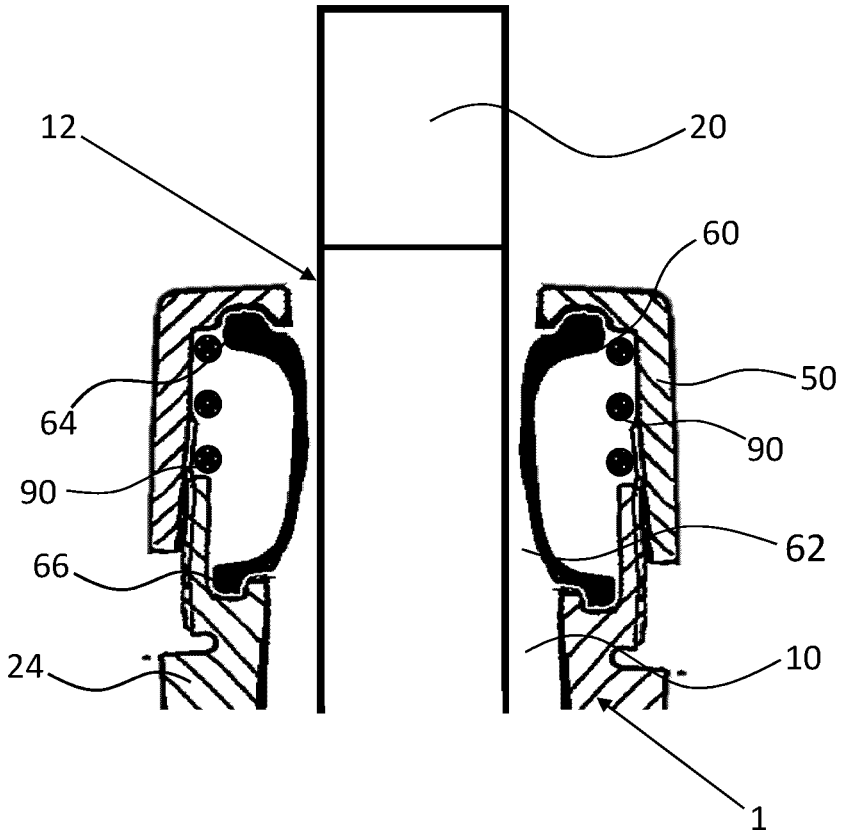
FIG. 7 is a cross-sectional schematic view of the distal end of an embodiment of the aerosol-generating article of FIG. 1 comprising a spring.

FIGS. 5 to 7 show how the actuation means 50 is engaged to the device housing 24. FIG. 5 shows a perspective view of the distal end of the aerosol-generating device, separate to the actuation means 50. A slot 80 is formed in the device housing 24. This slot 80 is configured to receive an engagement member of the actuation means. A corresponding slot is formed on the reverse side of the device housing 1 (not shown in FIG. 5). The slot 80 comprises a first end 82 and a second end 84. In the second end 84 of the slot, a locking portion 86 is formed. The slot 80 is angled such that the first end 82 is closer to the distal end of the aerosol-generating device than the second end 86.

FIG. 6 shows a bottom view of the actuation means, separately to the aerosol-generating device 1. In particular, FIG. 6 shows the actuation means 50 comprising two engagement members in the form of pins 88 formed in the housing of the actuation means 50. When the actuation member is properly assembled with the aerosol-generating device, each of the pins 88 is received in a slot 80. The slots 80 then guide the motion of the actuation means 50 with respect to the device housing 24.

A user of the aerosol-generating device may rotate the actuation means from a first position to a second position. In the first position, the pin 88 is received in the first end 82 of the slot. In the second position, the pin 88 is received in the second end 86 of the slot 80. As the slots 80 are angled in the longitudinal direction, the pins 88 in the slots 80 guide the actuation means 50 in the longitudinal direction (i.e. towards the cavity of aerosol-generating device 1). By moving the actuation means in the longitudinal direction, the two coaxially disposed rings of the adjustable retaining element are brought closer together. As described above, this results in the deformation of the adjustable retaining element 60.

FIG. 7 is a cross-sectional schematic view of the distal end of an embodiment of the aerosol-generating article 1 comprising a spring. The spring 90 is in contact with the device housing 24. Moving the actuation means from the first position to the second position deforms the spring 90. The deformed spring urges the actuation means 50 to return to the first position. When the actuation means 50 is in the second position, such that the pin is at the second end of the slot 80, the spring urging the actuation means 50 in the longitudinal direction pushes the pin 88 into the locking portion of the slot. The action of the spring on the actuation means then retains the pin in the locking portion 86 preventing the actuation means 50 from returning to the first position.

A user pushing on the actuation means in the longitudinal direction urges the pin out of the locking portion 86. The actuation member is then automatically returned the to first position by the action of the spring.

Alternatively, the actuation means 50 is attached to the device housing 24 by a thread and screw mechanism (not shown in the figures). This mechanism is configured such that rotation of the actuation means 50 with respect to the device housing 24 by a user of the device results in the actuation means 50 moving longitudinally with respect to the device housing 24. The screw and thread mechanism is configured such that rotation of the actuation means by 180 degrees with respect to the device housing 24 is enough to move the actuation means 2.5 millimeters longitudinally with respect to the device housing.

Figure 8:
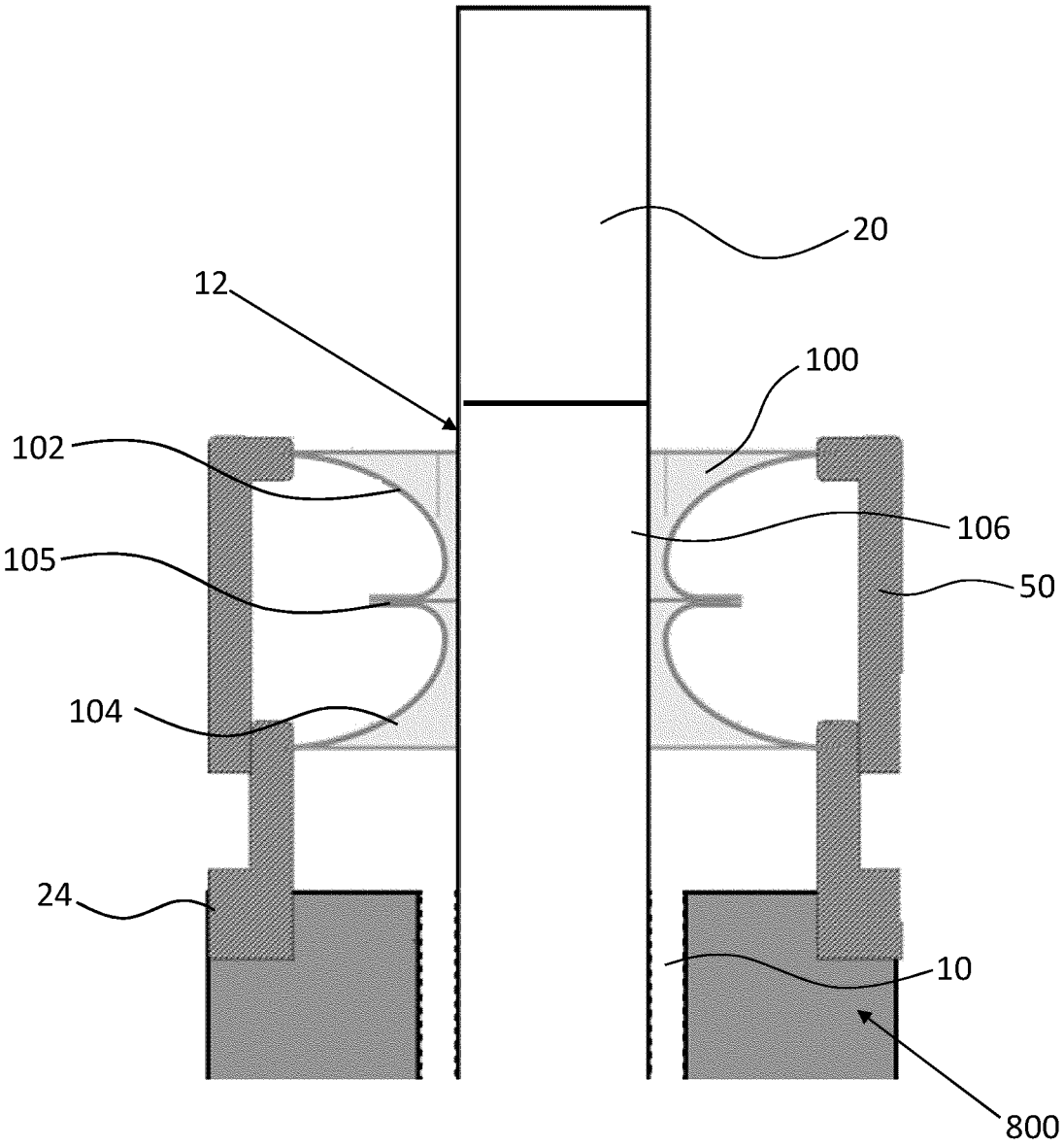
FIG. 8 shows an aerosol-generating device in accordance with the invention comprising a different adjustable retaining element to that of FIG. 1.

FIG. 8 shows an embodiment of the aerosol-generating device 800. Similarly to FIG. 1, only the distal portion of aerosol-generating device 800 is shown. The aerosol-generating device 800 is shown schematically and operates in the same manner as the aerosol-generating 1 shown in FIGS. 1, 2 and 3. The only difference between aerosol-generating 1 and aerosol-generating 800 is the adjustable retaining element.

Aerosol-generating device 800 comprises adjustable retaining element 100. The adjustable retaining element 100 comprises a first element 102 and a second element 104. The first element 102 forms the first side of the adjustable retaining element 100 and engages the actuation means. The second element 104 forms the second side of the adjustable retaining element 100 and engages the device housing 24. Both the first and second elements 102, 104 are formed of a resilient and elastic material. Both the first and second elements 102, 104 are annular. The first element 102 is connected to the second element 104 at connection 105.

The adjustable retaining element 100 operates similarly to the adjustable retaining element 60 shown in FIGS. 1, 2 and 3 in that movement of the actuation means 50 relative to the device housing 24 actuates the adjustable retaining element 100 from a receiving position to a retaining position such that the adjustable retaining element 100 is deformed.

When the adjustable retaining element 100 is deformed, each of the first and second elements 102,104 radially contract. Each of the first and second elements 102,104 define a convex curve shape and the curvature of each of these curves is greater when the adjustable retaining element 100 is in the retaining position. The turning points of each of the curves defines a constriction in a passage 106 defined by the adjustable retaining element 100. Therefore, the adjustable retaining element 100 of FIG. 4 defines two constrictions. These constrictions each form a point of contact with an aerosol-generating article 12 received in the passage 106 when the adjustable retaining element 100 is in the retaining position. Therefore, these constrictions contact two separate portions of an aerosol-generating article 12, the portions being spaced apart along the length of the aerosol-generating article 12.

The invention claimed is:

1. An aerosol-generating device, comprising:

a device housing defining a cavity;

an adjustable retaining element positioned in or adjacent to the cavity and defining a passage; and an actuation means comprising a housing engaged with the adjustable retaining element, wherein the actuation means is configured to actuate the adjustable retaining element between a receiving position and a retaining position, wherein a cross-sectional dimension of the passage is greater when the adjustable retaining element is in the receiving position than when the adjustable retaining element is in the retaining position, wherein the adjustable retaining element defines a passage entrance and a passage exit and comprises a surface defined between the passage entrance and the passage exit, a longitudinal cross-section of the surface having a curved shape, a portion of the curved shape comprising a convex curve defining a constriction in the passage at a turning point of the convex curve between the passage entrance and the passage exit, the convex curve having a curvature that is greater when the adjustable retaining element is in the retaining position than when the adjustable retaining element is in the receiving position, and wherein the adjustable retaining element is compressed in a longitudinal direction when the adjustable retaining element is actuated from the receiving position to the retaining position.

2. The aerosol-generating device according to claim 1, wherein the adjustable retaining element is deformed when the adjustable retaining element is actuated from the receiving position to the retaining position, and wherein the deformed adjustable retaining means constricts the passage.

3. The aerosol-generating device according to claim 1, wherein the cross-sectional dimension of the passage is a width of the passage.

4. The aerosol-generating device according to claim 3, wherein the width of the passage when the adjustable retaining element is in the receiving position is between 5 millimeters and 13 millimeters, and wherein the width of the passage when the adjustable retaining element is in the retaining position is between 4 millimeters and 9 millimeters.

5. The aerosol-generating device according to claim 1, wherein the cross-sectional dimension of the passage is a cross-sectional area of the passage.

6. The aerosol-generating device according to claim 5, wherein the cross-sectional area of the passage when the adjustable retaining element is in the receiving position is between 20 millimeters squared and 130 millimeters squared, and wherein the cross-sectional area of the passage when the adjustable retaining element is in the retaining position is between 10 millimeters squared and 60 millimeters squared.

7. The aerosol-generating device according to claim 1, wherein the surface extends around a portion of the passage to form a toroid.

8. The aerosol-generating device according to claim 7, wherein a distance between the passage entrance and the passage exit is reduced by between 2.5 millimeters and 5 millimeters when the adjustable retaining element is actuated from the receiving position to the retaining position.

9. The aerosol-generating device according to claim 1, wherein the cavity is configured to receive an aerosol-generating article.

10. The aerosol-generating device according to claim 9, wherein, in the retaining position, the adjustable retaining element is configured to substantially hermetically seal the cavity when the aerosol-generating article is received in the cavity while allowing airflow through the aerosol-generating article.

11. The aerosol-generating device according to claim 1, wherein the adjustable retaining element is a resilient element.

12. An aerosol-generating system comprising an aerosol-generating device and an aerosol-generating article;

the aerosol-generating device comprising:

a device housing defining a cavity;

an adjustable retaining element positioned in or adjacent to the cavity and defining a passage; and an actuation means comprising a housing engaged with the adjustable retaining element, wherein the actuation means is configured to actuate the adjustable retaining element between a receiving position and a retaining position, wherein a cross-sectional dimension of the passage is greater when the adjustable retaining element is in the receiving position than when the adjustable retaining element is in the retaining position, wherein the adjustable retaining element defines a passage entrance and a passage exit and comprises a surface defined between the passage entrance and the passage exit, a longitudinal cross-section of the surface having a curved shape, a portion of the curved shape comprising a convex curve defining a constriction in the passage at a turning point of the convex curve between the passage entrance and the passage exit, the convex curve having a curvature that is greater when the adjustable retaining element is in the retaining position than when the adjustable retaining element is in the receiving position, wherein the adjustable retaining element is compressed in a longitudinal direction when the adjustable retaining element is actuated from the receiving position to the retaining position, and wherein the aerosol-generating article is received in the cavity.

13. The aerosol-generating system according to claim 12, wherein a diameter of the aerosol-generating article is between 0.5 millimeters and 3.5 millimeters less than the width of the passage when the adjustable retaining element is in the receiving position.

14. A method of retaining an aerosol-generating article in an aerosol-generating device; the aerosol-generating device comprising a device housing defining a cavity, an actuation means comprising a housing engaged with an adjustable retaining element, and the adjustable retaining element positioned in or adjacent to the cavity, the adjustable retaining element defining a passage, the method comprising the steps of:

inserting the aerosol-generating article into the cavity; and actuating the adjustable retaining element from a receiving position to a retaining position, wherein a cross-sectional dimension of the passage is greater when the adjustable retaining element is in the receiving position than when the adjustable retaining element is in the retaining position, wherein the adjustable retaining element defines a passage entrance and a passage exit and comprises a surface defined between the passage entrance and the passage exit, a longitudinal cross-section of the surface having a curved shape, a portion the curved shape comprising a convex curve defining a constriction in the passage at a turning point of the convex curve between the passage entrance and the passage exit, the convex curve having a curvature that is greater when the adjustable retaining element is in the retaining position than when the adjustable retaining element is in the receiving position, and wherein the adjustable retaining element is compressed in a longitudinal direction when the adjustable retaining element is actuated from the receiving position to the retaining position.

* * * * *